US005950939A

United States Patent [19]

Drinkwater et al.

[11] Patent Number: 5,950,939

[45] Date of Patent: Sep. 14, 1999

[54] CONE CRUSHER FOR ROCK

[75] Inventors: Daniel C. Drinkwater, Cottage Grove; Roger M. Clark, Springfield; Gerald E. Parker; David F. Peaks, both of Eugene, all of Oreg.

[73] Assignee: Johnson Crushers International, Eugene, Oreg.

[21] Appl. No.: 09/139,208

[22] Filed: Aug. 24, 1998

[51] Int. Cl.[6] ..... B02C 2/04

[52] U.S. Cl. ..... 241/30; 241/207

[58] Field of Search ..... 241/27, 29, 207, 241/210, 214, 215, 30; 74/86, 87, 573 R

[56] References Cited

U.S. PATENT DOCUMENTS

| | | | |
|---|---|---|---|
| Re. 19,538 | 4/1935 | Rumpel | 241/216 |
| 1,863,529 | 6/1932 | Symons | 83/10 |
| 2,050,718 | 8/1936 | McCaskell | 83/10 |
| 2,185,528 | 1/1940 | Stevens | 83/10 |
| 2,310,737 | 2/1943 | Gruender | 83/10 |
| 2,359,987 | 10/1944 | Gruender | 83/10 |
| 2,590,795 | 3/1952 | Rumpel | 83/10 |
| 3,727,470 | 4/1973 | Choules | 74/87 |
| 3,731,556 | 5/1973 | Decker | 74/573 |
| 3,759,453 | 9/1973 | Johnson | 241/207 |
| 3,809,324 | 5/1974 | Cook | 241/210 |
| 4,192,472 | 3/1980 | Johnson | 241/215 |
| 4,566,638 | 1/1986 | Laudin | 241/37 |
| 4,571,112 | 2/1986 | Johnson | 403/320 |
| 4,589,600 | 5/1986 | Schuman | 241/215 |
| 4,683,681 | 8/1987 | Russ, III | 51/169 |
| 4,773,604 | 9/1988 | Johnson | 241/207 |
| 5,718,391 | 2/1998 | Musil | 241/207 |
| 5,782,110 | 7/1998 | Kim | 68/23.3 |

*Primary Examiner*—Joseph J. Hail, III
*Assistant Examiner*—Dermott J. Cooke
*Attorney, Agent, or Firm*—Robert L. Harrington

[57] ABSTRACT

A cone crusher for rock that has a rotatable wedge plate that rotatably supports a cone for crushing rock. The wedge plate has bores for receiving sized weights for balancing the rotating assembly. The bores place the weights out of the travel path of the crushed material and are not subject to wear or abrasion during operation of the crusher.

5 Claims, 2 Drawing Sheets

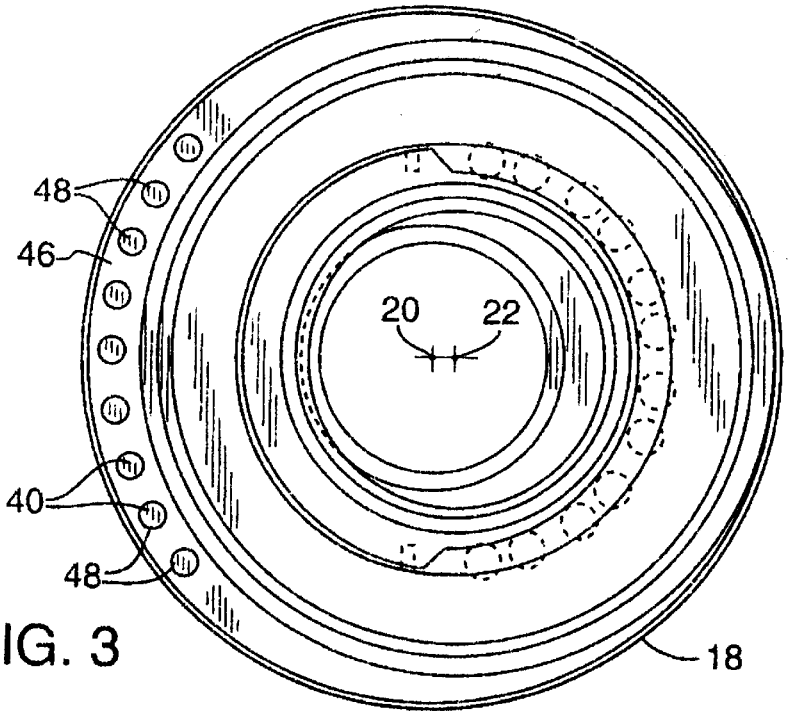
FIG. 3
FIG. 2
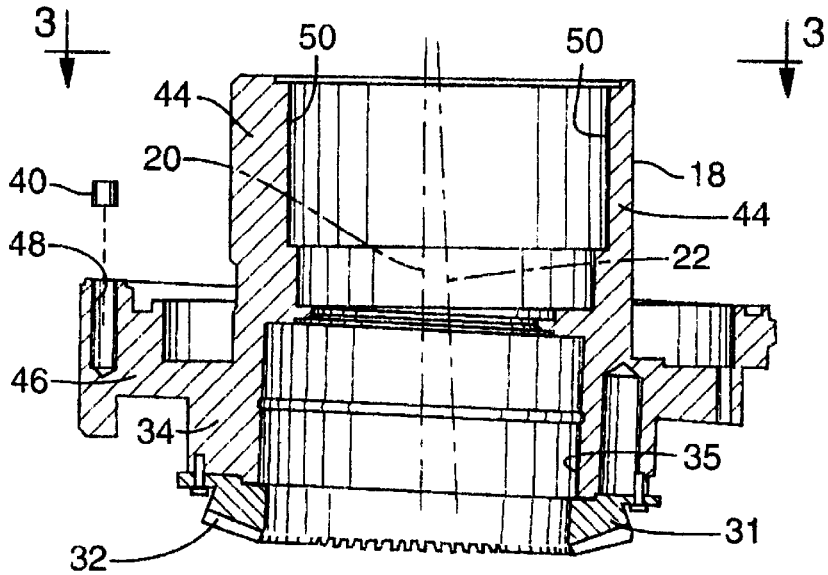
FIG. 4
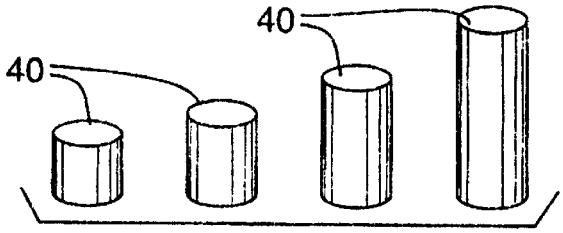

CONE CRUSHER FOR ROCK

FIELD OF THE INVENTION

This invention relates to a machine for crushing rock of a type referred to as a cone crusher wherein a crushing component is gyrated in a manner that affects weight distribution and causes vibration, the invention provides a way of balancing the weight distribution produced by such gyration.

BACKGROUND OF THE INVENTION

Cone crushers are used for crushing large rock into small rock or gravel such as used for road beds. A fixed liner forms a conical-shaped cover under which a conical-shaped cone is gyrated in a circular or rolling action. The cone is moved in a circular pattern such that the peripheral surface of the cone moves in close proximity along the inner circumferential surface of the liner. Material flowing between the liner and cone is crushed by the movement of the cone relative to the liner. The rolling action is achieved by orienting the cone to have an axis at a slight angle from vertical and then applying a gyrating movement whereby the offset axis is rotated around the fixed vertical axis of the liner, e.g., at a rate of 300 rpm.

The rotation of the offset axis is achieved by a cylinder-like support referred to as a wedge plate that rotates around the axis of the machine (also the axis of the liner). The cone has a center shaft and the cone and its shaft are symmetrical relative to the cone axis. The wedge plate confines the cone shaft within roller bearings that establish the axial position of the cone shaft at an offset relative to the wedge plate's axis of rotation. Rotation of the wedge plate thereby generates a rotation of the offset axis of the cone around the axis of the machine. The wedge plate is rotated at about 300 rpm and, therefore, the rotation of the cone's axis is also at 300 rpm. However, the cone itself does not rotate with the wedge plate and essentially rolls along the inner surface of the liner.

The cone as explained is substantially symmetrical relative to its axis but by offsetting that axis, the weight of the cone is unbalanced relative to the axis of rotation. The unbalanced weight sets up undesired vibration. To balance the offset weight of the cone, weight is added to one side of the wedge plate, i.e., opposite the offset axis. Whereas the offset weight of the cone can be calculated, the offsetting weight to be added to the wedge plate can be somewhat determined and that added weight can be provided in the basic design of the wedge plate. However, there are too many variables to achieve a balance that is fully satisfactory and a fine tuning of the weight distribution is necessary for each machine after final assembly.

Heretofore it was common to simply add weights to the wedge plate exterior, e.g., the weights were bolted onto the wedge plate. This process is time consuming and leaves the weight exposed to the crushed rock passing through the crusher which can erode or wear away at the weights and require replacement.

BRIEF SUMMARY OF THE INVENTION

In the preferred embodiment of the invention, the wedge plate is provided with strategically located pockets of common size positioned at the periphery of the wedge plate in the area opposite the offset axis. Weights are provided to fit the pockets and the pockets are designed to each hold one or more of the weights. Once the machine is assembled, the weights are added based on projected weight distribution and the operation of the machine is tested. Weights are then added and/or redistributed to various pockets to achieve the desired balance. It will be appreciated that the weights can be readily removed and rearranged in the pockets for redistribution thereof following prolonged use, e.g., as may be required due to wearing or other factors such as a change in the linear configuration. The pockets (and the weights received therein) are accessible without dismantling of the crushing machine. Also, the pockets substantially enclose the weights and protect the weights from being impinged by the crushed rock.

The invention and its advantages will be further appreciated upon reference to the following detailed description and the accompanying drawings.

BRIEF DESCRIPTION OF THE DRAWINGS

FIG. 2 is a sectional view of a wedge plate of the crusher of FIG. 1;

FIG. 3 is a top view of the wedge plate of FIG. 2; and

FIG. 4 is a view of weights of various sizes insertable into pockets of the wedge plate of FIGS. 2 and 3.

DESCRIPTION OF THE PREFERRED EMBODIMENT

Figure 1:
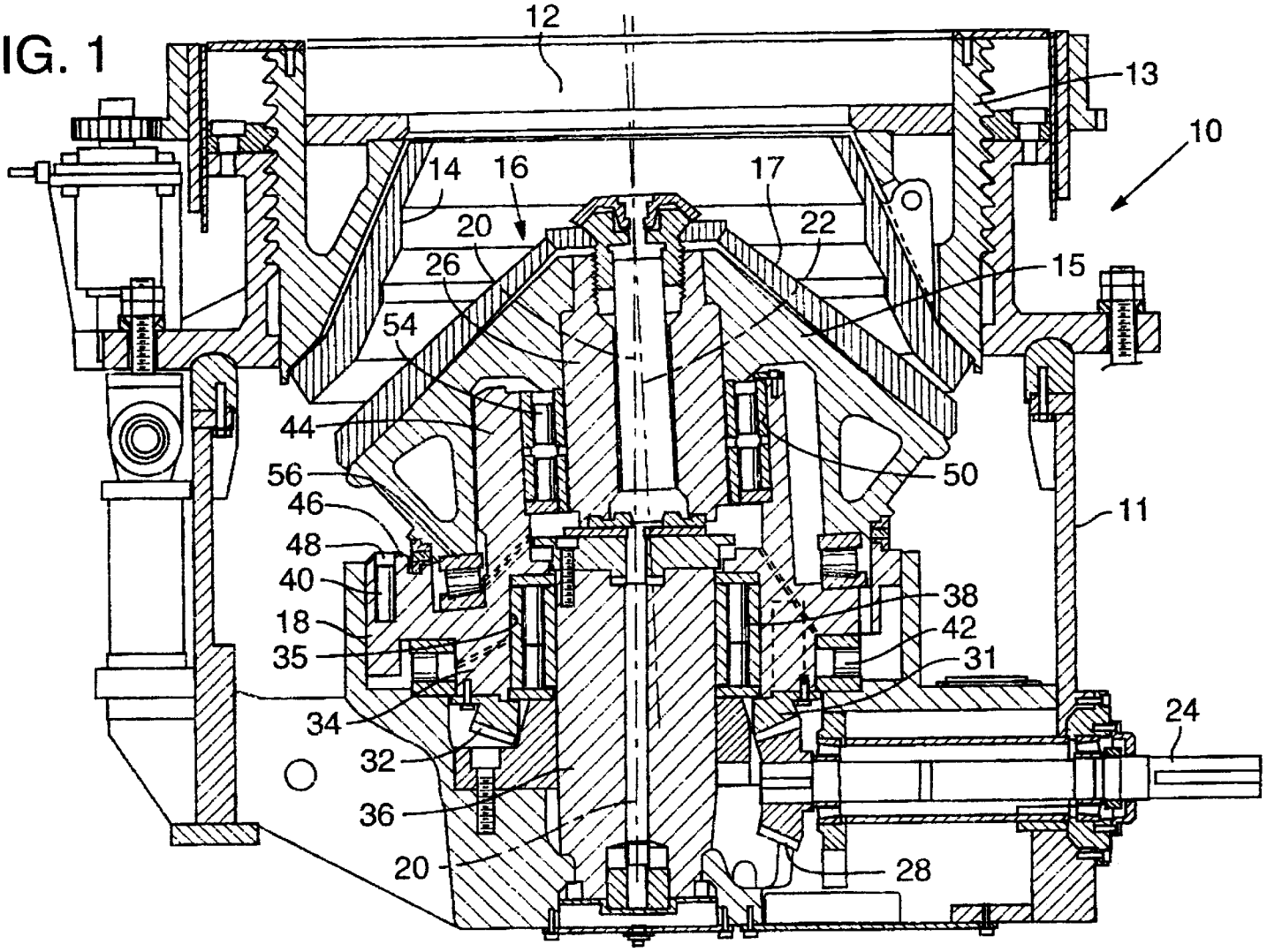
FIG. 1 is a sectional view of a cone crusher of the present invention.

FIG. 1 illustrates a cone-type crusher 10 arranged to reduce material such as rock into smaller particles. The crusher 10 has a conically-shaped entry 12 that has a replaceable conical liner 14. A crushing cone 16 having a removable mantle 17 is movably mounted strategic to the liner 14. The cone 16 is arranged to crush the material against the liner 14 as the material flows through the entry 12.

The liner 14 is mounted to a removable shroud 13 which is threadably secured to the main frame 11. Removal of the shroud 13 provides f or removal and replacement of the liner 14 as well as components of the cone 16, e.g., the mantle 17.

Secured to the main frame 11 is a center post 36 that defines a center axis 20 of the machine. A wedge plate 18 (see also FIG. 2) consists of a bottom portion 34 having a cylindrical bore 35 and an upper portion 44 having a cylindrical bore 50. The bottom portion 34 is rotatably mounted to the center post 36 as provided by bearings 38 and 42. A bevel gear 31 having bevel teeth 32 is secured to the bottom of the wedge plate 18.

A drive shaft 24 protrudes through the main frame 11. Bevel teeth 28 on shaft 24 engage teeth 32 of bevel gear 31 for rotating the wedge plate 34 about the center post 36 and thus about the center axis 20.

The cone 16 includes a mantle support 15 having a center post 26. The mantle support 15 is supported both within the bore 50 of the upper portion 44 and surrounding upper portion 44 as provided by bearings 54 and 56. As particularly noted in FIG. 2, the axis 22 of cylindrical bore 50 is offset from axis 20 of cylindrical bore 35. It will be appreciated that as the wedge plate 18 rotates about post 36 and axis 20, axis 22 will similarly rotate about axis 20.

It follows that cone 16, which is mounted relative to axis 22, will follow the rotation of axis 22 and produce a gyrating motion of the cone. As will be seen in FIG. 1, with the axis 22 tilted to the right of axis 20, the mantle 17 is cocked to the right and positions the mantle in close relation to the liner 14. The opposite side, i.e., the left side of FIG. 1, illustrates the liner and mantle in spaced apart relation. The location of close relationship between the liner and mantle is dictated by the position of the axis 22 and thus rotates around the fixed liner at the rotation of the wedge plate, e.g., 300 rpms.

Because of the rotatable relation between cone 16 and wedge plate 18, cone 16 is not rotatably driven by the rotation of the wedge plate (which is rotatably driven by drive shaft 24). Nevertheless, axis 22 rotates around axis 20 as dictated by rotation of the wedge plate, and cone 16 rapidly gyrates but does not rotate to any significant degree. In practice, cone 16 actually rotates in reverse by a small rpm, e.g., 7 rpm. This is because the mantle is in effective contact with the liner through the crushing of the rock, and rolls around the inside of the liner. The distance around the contacted surface of the liner is greater than the distance around the contacted surface of the mantle and thus a complete revolution of the wedge plate and axis 22 produces minor and reverse rotation of the cone.

The cone is symmetrical about its axis 22, and because it is tilted as dictated by axis 22, there is an imbalance of weight relative to the axis of rotation, i.e., axis 20. The imbalance is always at the same radial location as axis 22 rotates around axis 20. No part of the cone 16 is fixed relative to axis 22 and thus adding offsetting weight to cone 16 is not an option. However, wedge plate 18 dictates the location of axis 22 and is fixed relative to axis 22. Offsetting weight can be added to wedge plate 18 and produce the desired balance. Cylinder portion 44 of the wedge plate is designed to have offsetting weight as will be noted in FIG. 1 (the wall thickness of portion 44 is greater at the position opposite axis 22).

Wedge plate design by itself cannot be established with precise offsetting weight (there are too many variables in the complexity of the components and assembly). It is thus necessary following assembly to further balance the assembly to alleviate undesired vibration. A test program has been established and weights are added (or redistributed) as needed to achieve balance.

As seen in FIGS. 1 and 2, the wedge plate is designed to have a skirt portion 46 which, as will be noted in FIG. 1, is located substantially under the liner 17 but spaced below the liner for accessibility. The skirt portion is provided with pockets 48 in a pattern as seen in FIG. 3 and positioned opposite the position of the axis 22. Cylindrical disks such as indicated in FIG. 4 are sized in diameter to fit the openings 48 and are added to selective ones of the pockets until the desired balance is achieved. The pockets 48 are accessible without disassembly of the crusher to facilitate adding or removing weights from the pockets 48.

The weights 40 are sized in height or vertical dimension to the convenience of the operator. Small disks as shown at the left side of FIG. 4 may be used exclusively or a combination of any or all of the disks may be used.

It will be appreciated that the weights 40 may be provided at a height to fit the pocket 48. The weight 40 has material removed such as by counter-boring in a conventional manner to vary the net weight of each weight 40.

In the process of building a cone crusher in accordance with the invention, the parts or components are assembled as previously indicated in the description of FIG. 1. Following assembly, from experience and calculation, a number of the pockets 48 are provided with weights 40 to achieve near balance. The machine is then placed on a test stand and the cone 16 is rotated. To the extent that unacceptable vibration still exists, e.g., movement exceeds 0.020 of an inch, the machine is stopped and weights are added or redistributed among the pockets 48. The machine is again tested and the process repeated until the desired balance is achieved.

Those skilled in the art upon learning of the invention herein will conceive of numerous variations which are nevertheless encompassed by the inventions. The disclosed apparatus and process is presented herein by way of example only and the scope of the invention is to be determined from the claims appended hereto.

We claim:

1. A rock crushing machine comprising:

an overhead member having a conical-shaped bottom surface;

a cone-shaped member underlying the overhead member and having a conical-shaped top surface mated to the bottom surface of the overhead member;

said overhead member fixed with the conical-shaped bottom surface defining a fixed axis, and said cone-shaped member mounted for gyrating motion whereby a portion only of the top surface is in a determined close proximity to the bottom surface and as a result of the gyrating motion, such portion and position thereof changes continuously in a circular pattern around the fixed axis;

said conical-shaped top surface defining an axis that is angled relative to the fixed axis and rotates around the fixed axis as a result of the gyratory motion of the cone-shaped member;

a mount member, a base portion of the mount member mounted for rotation around the fixed axis and including an offset cone mounting portion, said cone-shaped member rotatably mounted on the offset cone mounting portion for establishing the angled axis of the conical-top surface;

a drive mechanism for rotatably driving the mount member about the fixed axis and thereby rotating the axis of the conical-shaped top surface around the fixed axis and thereby producing an imbalance in weight distribution; and an offset weight balancing feature wherein said mount member has a periphery defining a skirt portion accessible from under the cone-shaped member following completed assembly of the machine, a pocket formed in said skirt portion and a weight or weights selectively inserted into the pocket to balance the weight distribution for alleviating undesired vibration.

2. A rock crushing machine as defined in claim 1 wherein the cone-shaped member is rotatably mounted to said mount member and has a weight distribution symmetrical relative to its axis and non-symmetrical relative to said fixed axis, said mount member designed to have non-symmetrical weight distribution relative to said fixed axis for offsetting in part the offset weight distribution of the cone-shaped member, and said offset balancing feature including a plurality of pockets arranged in a peripheral pattern for receiving weights selectively added to the pockets for achieving balance.

3. A rock crushing machine as defined in claim 2 wherein the skirt and pockets therein and the weights contained in the pockets are substantially under the conical-shaped top surface and substantially protected from crushed rock falling off the conical-shaped top surface.

4. A cone crusher comprising:

a fixed overhead conical-shaped crushing surface, an axis defined by said fixed crushing surface;

a cone defining a conical-shaped crushing surface gyrating under and relative to the overhead conical-shaped crushing surface, said cone defining an axis about which the weight of the cone is symmetrically distributed;

a rotating wedge plate supporting the cone and rotating the axis of the cone about the axis of the fixed crushing surface to provide said gyrating of the conical-shaped crushing surface and thereby producing an offset weight distribution of said cone relative to said fixed axis; and said wedge plate having a skirt, pockets formed in said skirt and weights removably insertable in said pockets following assembly of the crusher for relative distribution among the pockets for balancing the weight distributed about said fixed axis.

5. A method of balancing a cone crusher having a cone defining a conical-shaped crushing surface gyrating under and relative to a fixed overhead conical-shaped crushing surface, the gyrating motion produced by a rotating wedge plate supporting the cone and rotating an axis defined by the crushing surface of the cone around an axis defined by the fixed crushing surface; wherein said method of balancing comprises:

providing a skirt portion for the wedge plate and forming receiving pockets in the skirt portion with said pockets accessible for inserting weights after assembly of the cone crusher; and providing a plurality of weights designed to fit the pockets and placing the weights in the pockets as desired to alleviate vibration produced by the gyratory motion of the cone.

* * * * *